US012296222B2

(12) United States Patent
True

(10) Patent No.: US 12,296,222 B2
(45) Date of Patent: May 13, 2025

(54) SLIDING EXERCISE DEVICE

(71) Applicant: Shawn True, Batavia, IL (US)

(72) Inventor: Shawn True, Batavia, IL (US)

( * ) Notice: Subject to any disclaimer, the term of this patent is extended or adjusted under 35 U.S.C. 154(b) by 236 days.

(21) Appl. No.: 17/832,798

(22) Filed: Jun. 6, 2022

(65) Prior Publication Data

US 2022/0387847 A1 Dec. 8, 2022

Related U.S. Application Data

(60) Provisional application No. 63/196,758, filed on Jun. 4, 2021.

(51) Int. Cl.

| | |
|---|---|
| ***A63B 21/04*** | (2006.01) |
| ***A63B 21/00*** | (2006.01) |
| ***A63B 22/00*** | (2006.01) |
| ***A63B 22/20*** | (2006.01) |

(52) U.S. Cl.

CPC ..... *A63B 22/203* (2013.01); *A63B 21/00065* (2013.01); *A63B 21/0428* (2013.01); *A63B 21/4033* (2015.10); *A63B 2022/003* (2013.01); *A63B 2208/0204* (2013.01)

(58) Field of Classification Search

CPC ..... A63B 2208/0204; A63B 2202/003; A63B 22/203; A63B 21/00065; A63B 21/0428; A63B 21/4033; A63B 22/208; A63B 22/201

See application file for complete search history.

(56) References Cited

U.S. PATENT DOCUMENTS

| | | | | |
|---|---|---|---|---|
| 4,506,884 | A * | 3/1985 | Hankin | A63B 23/0488 482/131 |
| 6,440,045 | B1 * | 8/2002 | Gaston | A63B 21/4045 482/91 |
| 2003/0216230 | A1 * | 11/2003 | Wang | A63B 23/0488 482/126 |
| 2007/0135280 | A1 * | 6/2007 | Hamer | A63B 23/0355 482/148 |
| 2014/0031175 | A1 * | 1/2014 | Peralo | A63B 21/4045 482/66 |
| 2022/0023714 | A1 * | 1/2022 | Holman | A63B 21/0428 |

OTHER PUBLICATIONS

Leaderboard Golf Training Aid—www.puregolftraining.com; www.amazon.com.

* cited by examiner

*Primary Examiner* — Loan B Jimenez
*Assistant Examiner* — Jonathan A Dicuia
(74) *Attorney, Agent, or Firm* — Scherrer Patent & Trademark Law, P.C.; Stephen T. Scherrer; Monique A. Morneault

(57) ABSTRACT

The present disclosure relates to a device or apparatus for use in exercising and physical therapy. In particular, the present disclosure relates to a sliding exercise device and system useful for exercising multiple areas of the body. The present device is particularly useful for targeting the hips, thighs, core, upper body and associated muscles for strengthening and/or rehabilitation. The device can used by individuals seeking strength and balance training but is also useful for rehabilitation. The present device is also portable, making it useful for use at a home and/or at a gym or rehabilitation facility.

14 Claims, 7 Drawing Sheets

SLIDING EXERCISE DEVICE

TECHNICAL FIELD

The present disclosure relates to an exercise device or apparatus. More specifically, the present disclosure relates to a sliding exercise device, which is useful for exercising multiple areas of the body, individually or together. The device or apparatus is useful for individuals with disabilities, for use in rehabilitation, as well as for general fitness training at a gym, home or other facility.

BACKGROUND

It is, of course, generally known to use various apparatus and devices for exercising, to enhance fitness and training, but also for rehabilitation after injury, surgery or other medical issues. There are many different types of exercise equipment and apparatus designed for targeting different areas of the body and/or for focusing on improving certain areas of weakness or improving the strength of the user. As well, devices used for rehabilitation can also be designed to work on a specific area the user needs to improve, strengthen or rehabilitate. However, not all exercise equipment is designed for use by both those seeking to strengthen multiple areas of the body and is also useful by those requiring rehabilitation.

In terms of rehabilitation, the hips are one of the most rehabbed/exercised muscle and bone groups. The hips, legs and associated muscles are critical for movements such as sitting to standing, walking, running, and balance. Additionally, as many jobs and careers have moved to primarily to sitting, computer-based occupations, the amount of time individuals spend in seated, stationary positions has significantly increased. This means the hips, legs and associated muscles may not receive adequate exercise, resulting loss of muscle tone, flexibility and balance. Furthermore, in our aging society, hip replacements have become all too common, requiring significant rehabilitation.

One of the most popular exercises for use in hip rehabilitation for physical therapy and at the gym is using essentially a large rubber band placed around the ankles. The user then sidesteps repeatedly with the band around the ankles to try to strengthen the outside of the hips. However, because this form of exercise requires an element of balance, restricting the ankles in this manner can potentially pose an issue to someone who is not very agile, at high fall risk and/or elderly, those with prosthetic limbs, and/or people with a variety of disabilities. Therefore, this common exercise is not suitable for everyone.

The present sliding exercise device eliminates the need for the band around the ankles. Additionally, the low center of gravity of the present device, such that the user only has to step up 3 inches or less off the ground, is also advantageous for users particularly with balance issues. After stepping onto the device, the user can maintain control and balance by holding onto a bar, a wall, or possibly another person, as necessary.

Another way to train/rehabilitate the hip and associated muscles is by sitting in a very large and expensive machine where the individual sits and spreads his/her knees apart or squeezes the knees together to work the muscles. However, many gyms no longer have these machines as they are expensive and require a lot of space. Additionally, these machines can be uncomfortable and difficult to use for many users.

Another device for use with the legs, hips and associated muscles is a Pilates reformer. While these machines are useful and beneficial, they are expensive and require a lot of space. Additionally, there machines are higher off the ground, which may make it difficult for some users.

The present sliding exercise device eliminates the need for these large, expensive machines. Using the present device effectively works all sides of the hip and all the muscles in the thigh and hip on a device that may only be 15 to 20 pounds, making it easily portable for optimum placement and use.

Additionally, the portability of the present device means a physical therapist, or a personal trainer can put the device in his/her vehicle trunk or backseat and easily transport for use with home patients or clients. The present device is also simpler in operation and can be constructed for a much lower price than the large and more expensive machines it is designed to replace.

A need, therefore, exists for improved exercise device. Specifically, a need exists for a device or apparatus which is useful for exercise, strength training, balance and rehabilitation for upper and lower areas of the body.

A need further exists for an improved exercise device which is useful for targeting upper and lower areas of the body, including the hips, legs, core, arms, back and associated muscles for strength training and balance.

Additionally, a need exists for an improved exercise device which is useful for targeting upper and lower areas of the body, including hips, legs, core, arms, back and associated muscles for rehabilitation.

A need further exists for an improved exercise device useful for strength, balance and rehabilitation training for persons with and without disabilities or other restrictions.

A need also exists for an improved portable exercise device useful for strength, balance and rehabilitation training.

A need further exists for an improved exercise device useful for strength, balance and rehabilitation training, which is simpler in construction, affordable, and replaces existing large, expensive and cumbersome machines.

SUMMARY

The present disclosure relates to exercise equipment and devices or apparatus. In particular, the present disclosure relates to a sliding exercise device, which is useful for exercising multiple areas of the body. The present device is useful for targeting the hips, legs and associated muscles for strengthening and rehabilitation; however, the device may also be used for upper body movement and exercise for the core, shoulders, back and arms. The device can be used by individuals seeking general fitness training relating to strength and balance, but also for rehabilitation. The portability of the present device also makes it convenient for use at home, at a gym, or at a rehabilitation facility.

To this end, in an embodiment of the present disclosure, a sliding exercise device is provided. The exercise device comprises a frame formed from first and second opposing ends connected to first and second opposing sides creating an open interior space, a first panel positioned at the first end of the frame, a second panel positioned within the interior space of the frame and in longitudinal arrangement to the first panel. The second panel slides longitudinally along the length of the frame in a first direction and in a second opposing direction in relation to the first panel, which remains stationary.

In another embodiment, an exercise apparatus is provided. The exercise apparatus comprises a frame formed from first and second opposing ends connected to first and second opposing sides creating an open interior space, a first panel positioned in a stationary position on the frame, a second panel positioned within the interior space of the frame between the first and second opposing sides and in alignment to the first panel, wherein the second panel is capable of lateral movement in two opposing directions. The exercise apparatus includes a resistance component, which is useful for adjusting the lateral movement of the second panel.

It is, therefore, an advantage and objective of the present disclosure to provide an improved exercise device or apparatus for use in both general exercise and for rehabilitation. Specifically, the present disclosure provides an improved exercise device or apparatus which is useful for exercise and rehabilitation for both the upper and lower areas of the body, but primarily targeting the hips, legs and associated muscles.

It is yet another advantage and objective of the present disclosure to provide an improved exercise device which replaces large, expensive exercise machines in terms of ease of use and costs.

It is a further advantage and objective of the present disclosure to provide an improved exercise device which is portable.

Additional features and advantages of the present disclosure are described in, and will be apparent from, the detailed description of the embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

The present disclosure relates to exercise equipment and devices. In particular, the present disclosure relates to a sliding exercise device or apparatus which is useful for exercising multiple areas of the body. The present device is particularly useful for targeting the hips, thighs, core and associated muscles for strengthening and rehabilitation; however, it may also be used to strength and rehabilitation of the back, arms and shoulders. The device can be used not only by individuals seeking strength and balance training but is also useful for rehabilitation and for general fitness training at home, at a gym, or at a rehabilitation facility.

The present sliding exercise device is designed to supplement or potentially replace large, expensive bulky machines that are typically used for exercise and rehabilitation. Another feature of the present exercise device is that it is small enough to be easily transported in the trunk of a vehicle so that it can be set-up in a gym, home or rehabilitation facility. Having a portable device for in-home use may be advantageous for those individuals who cannot easily leave home and are in need of rehabilitation.

Figure 1:
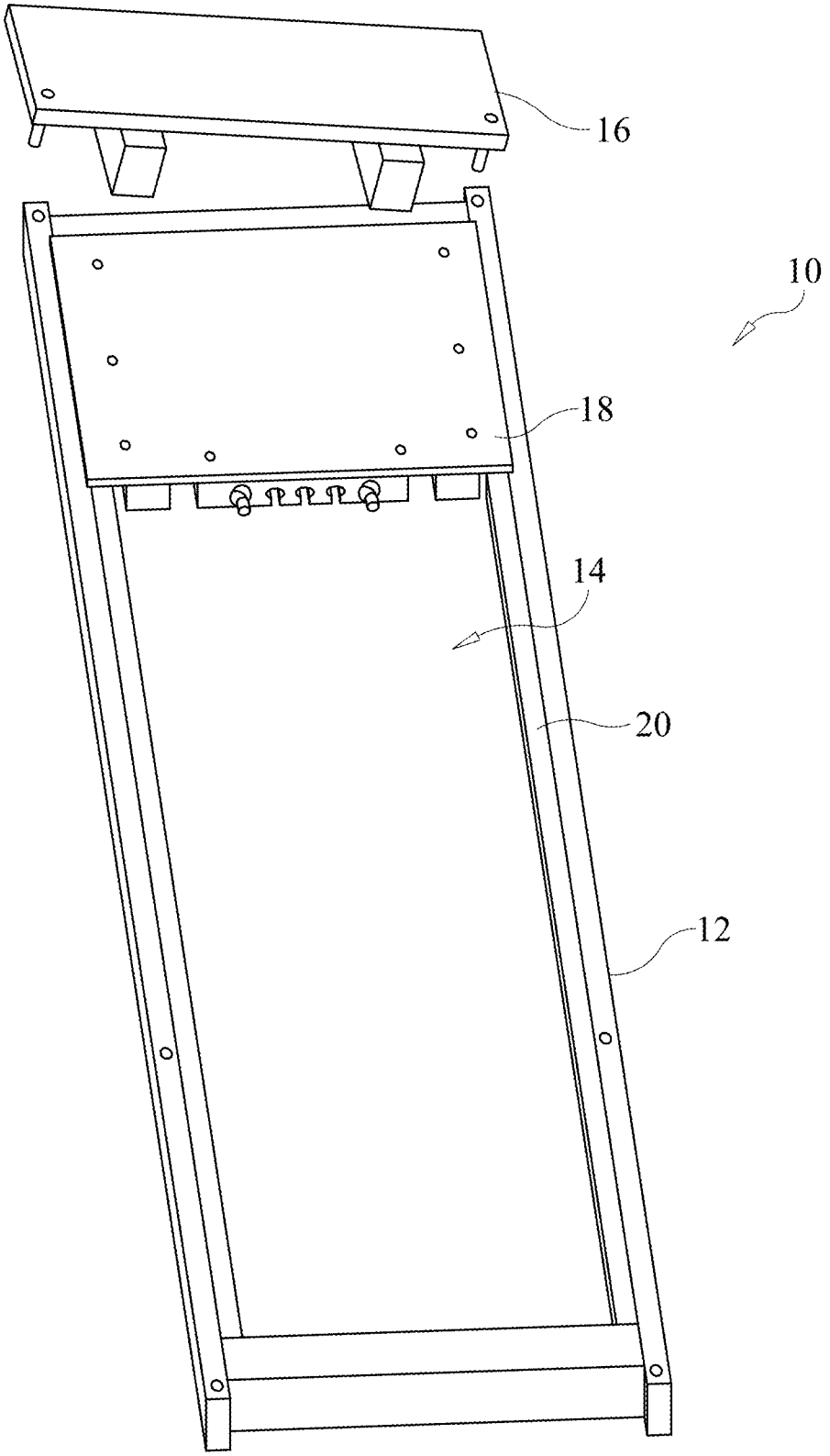
FIG. 1 illustrates a perspective view of a sliding exercise device according to the present disclosure.
Figure 2:
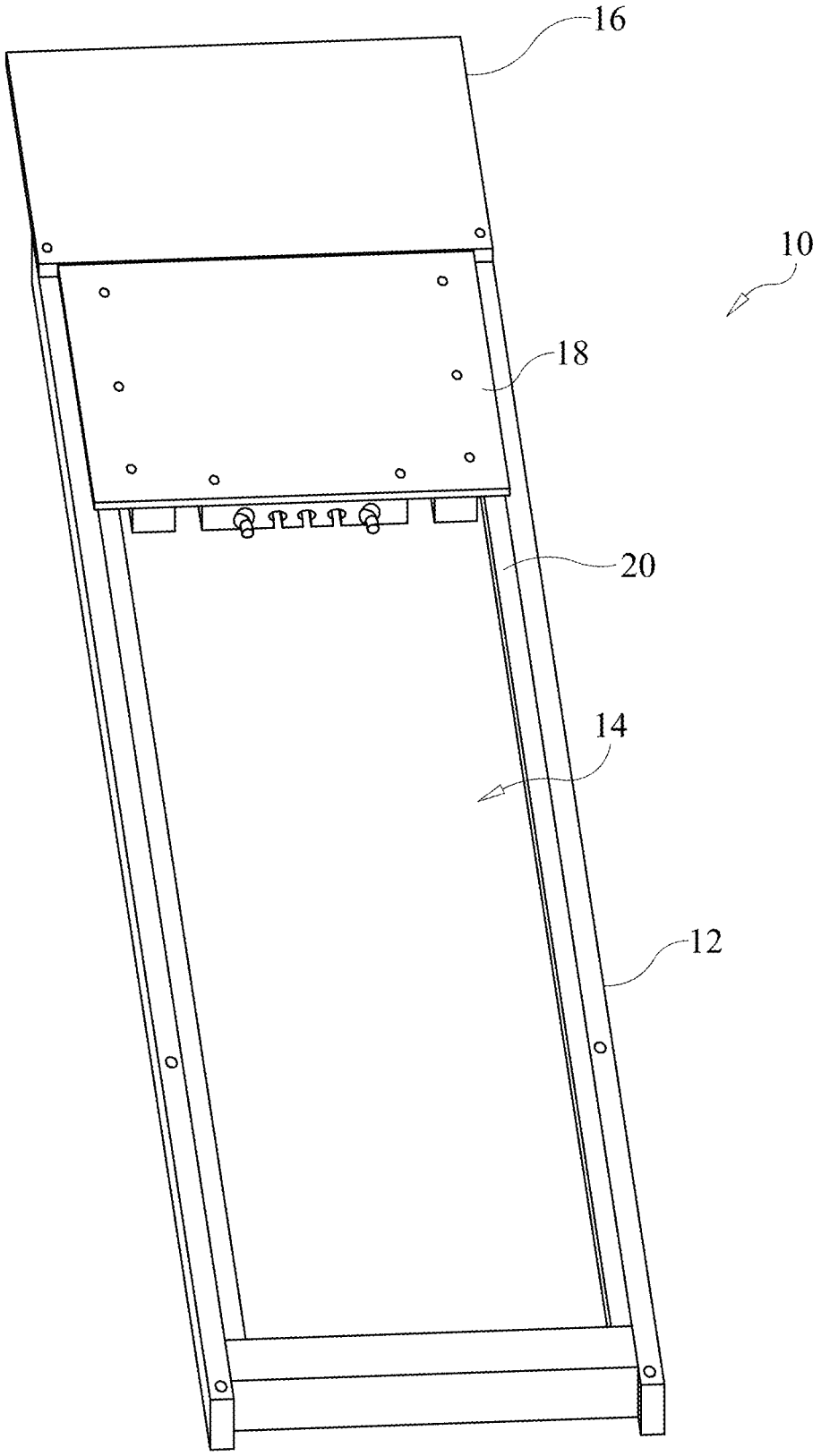
FIG. 2 illustrates another perspective view of the sliding exercise device according to the present disclosure with both panels attached to the frame.
Figure 3:
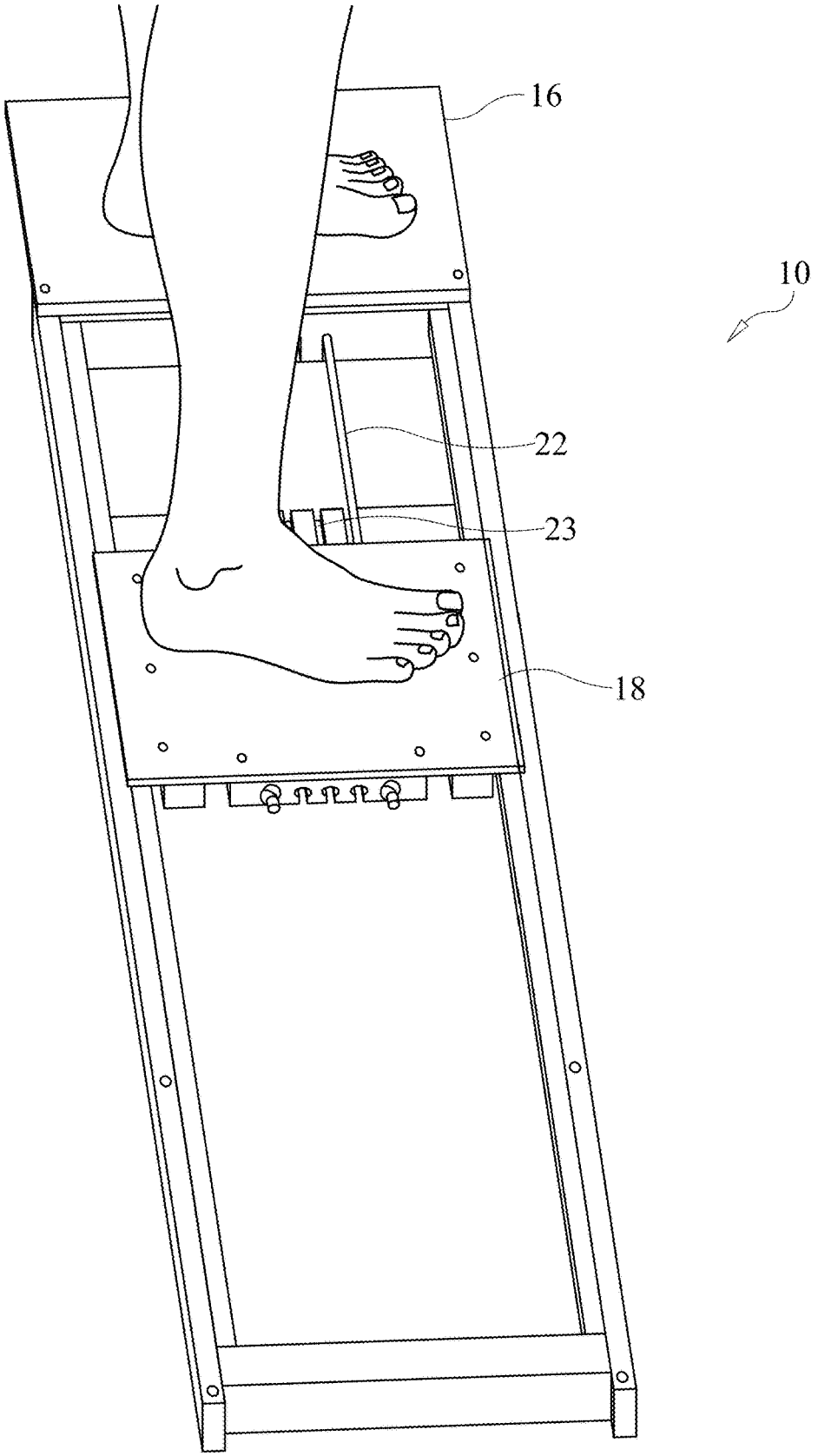
FIG. 3 illustrates a perspective view of the sliding exercise device in use.
Figure 4:
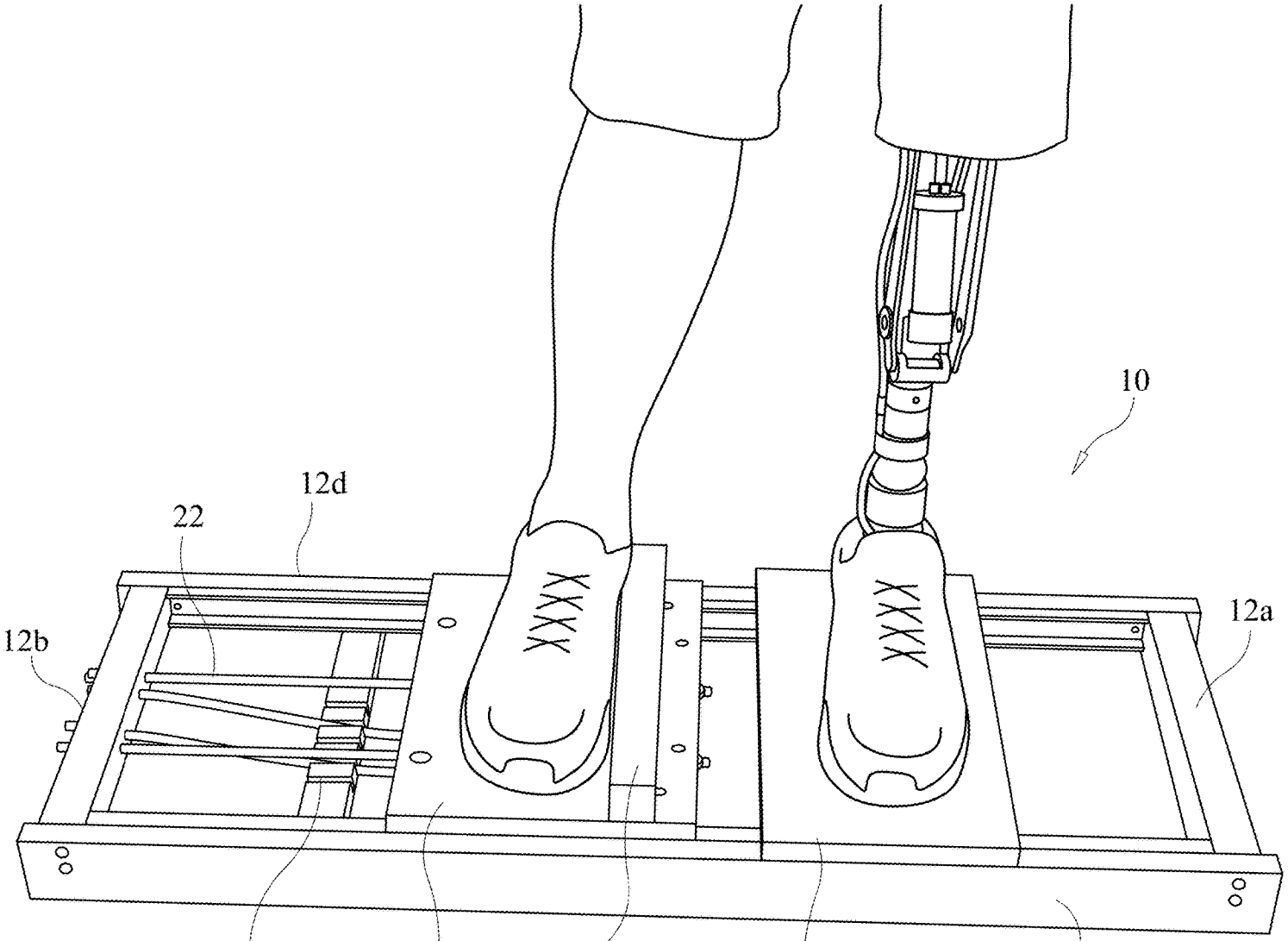
FIG. 4 illustrates another perspective view of the sliding exercise device of the present disclosure in use.
Figure 5:
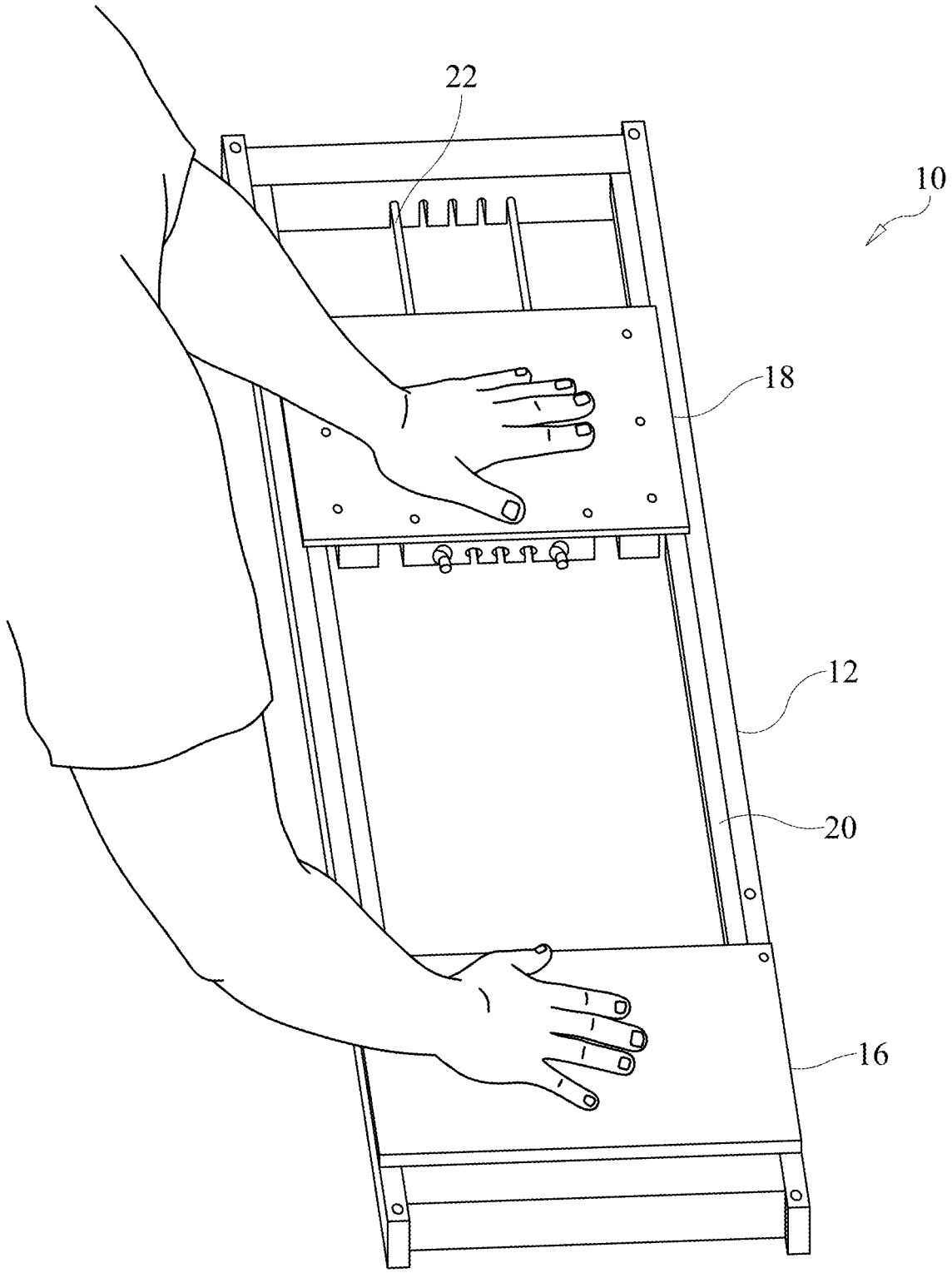
FIG. 5 illustrates another perspective view of the sliding exercise device of the present disclosure in use.
Figure 6:
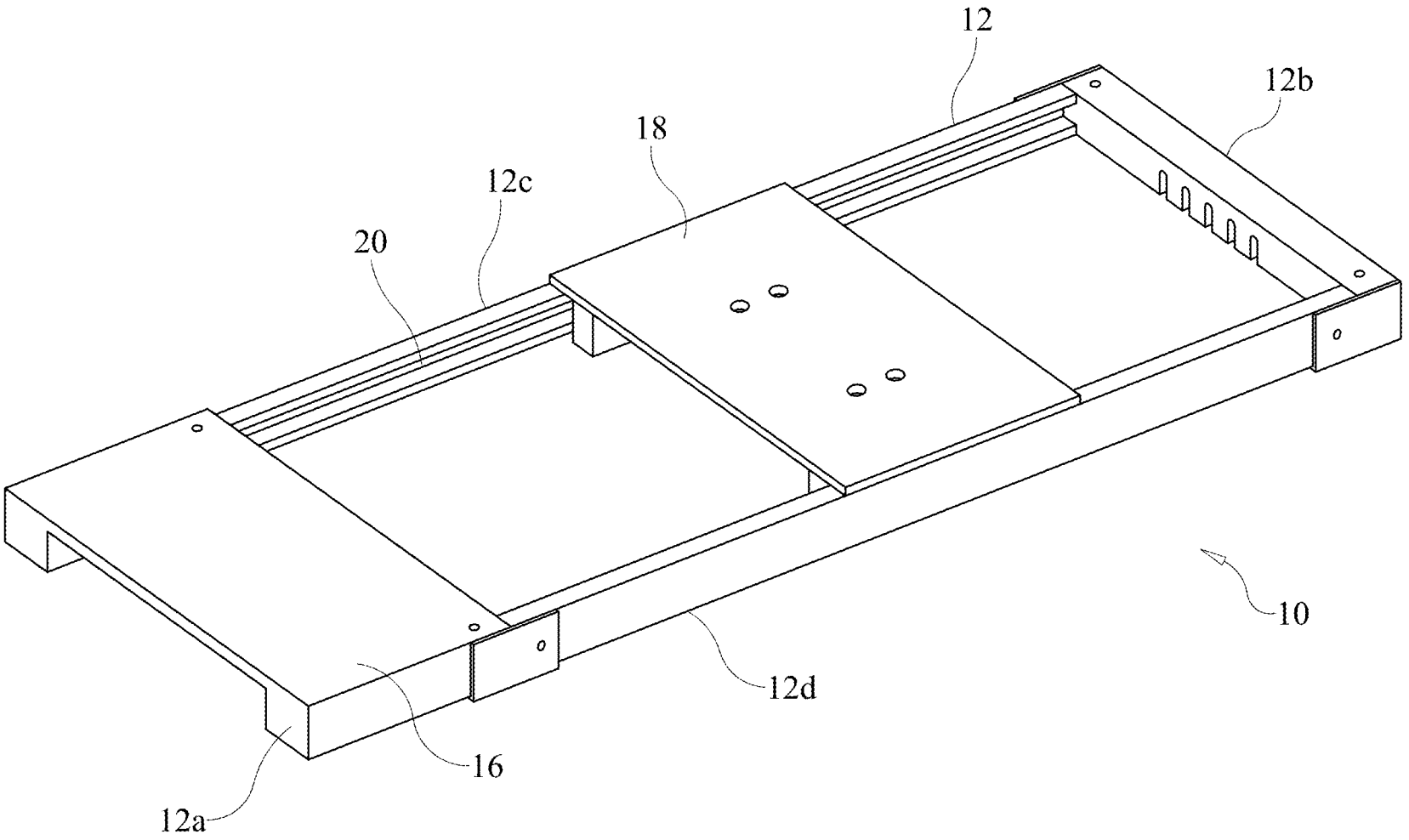
FIG. 6 top view of the sliding exercise device according to the present disclosure; and, FIG. 7 illustrates a bottom view of the sliding exercise device according to the present disclosure.
Figure 7:
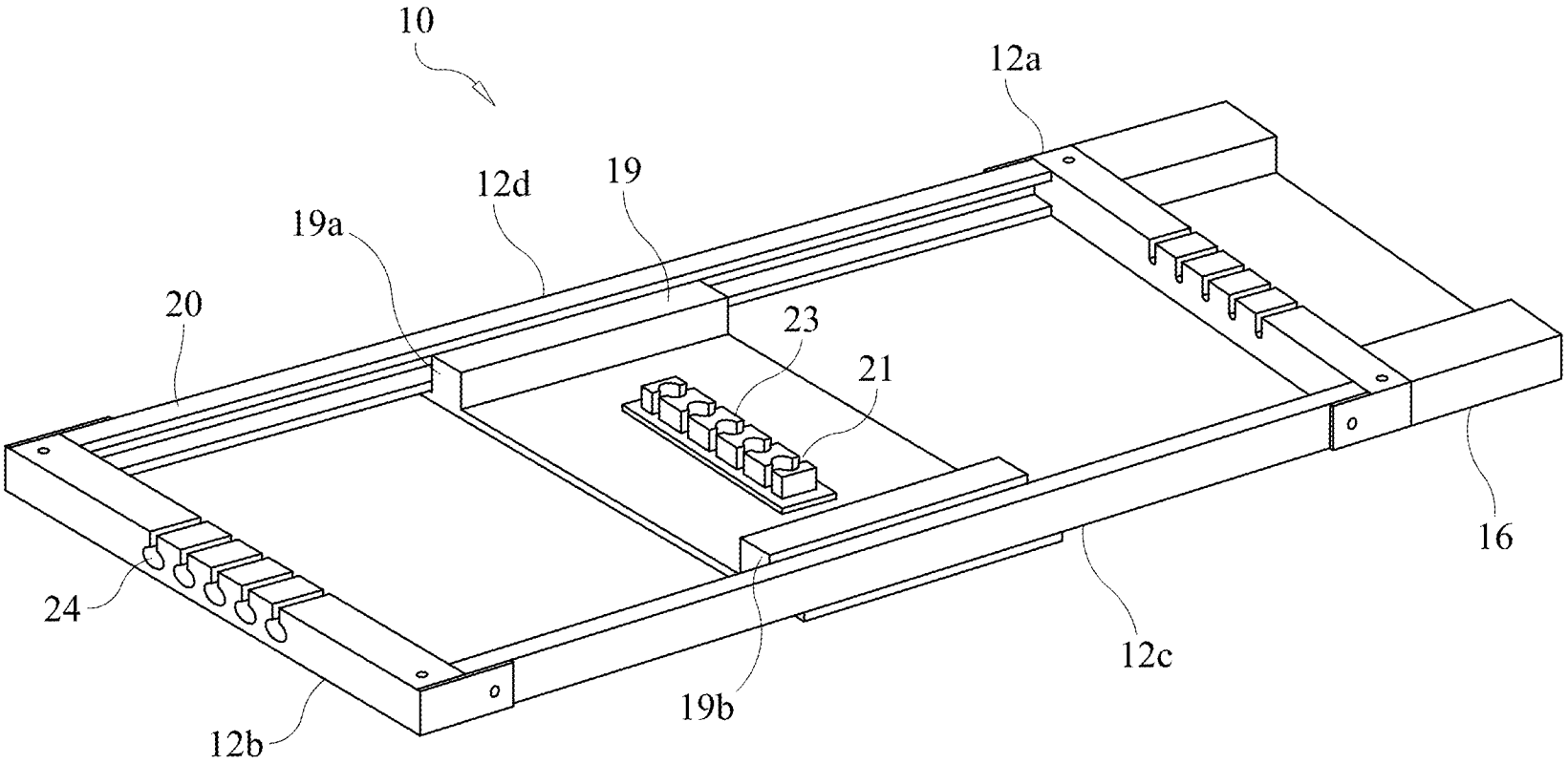

Now referring to the figures, wherein like numerals refer to like parts, FIGS. 1 and 2 illustrates perspective views of a sliding exercise device according to the present disclosure. FIGS. 3-5 illustrates different uses of the sliding exercise device according to the present disclosure. FIG. 6 illustrates a top view of the sliding exercise device, and FIG. 7 illustrates a bottom view of the device according to the present disclosure.

FIGS. 1, 2 and 6 illustrate a sliding exercise device 10 of the present disclosure. The sliding exercise device 10 is designed generally having a rectangular frame 12, with two short opposing sides, creating a first end 12*a* and a second end 12*b*, which are connected to two opposing longer sides 12*c*, 12*d* forming an interior enclosure 14. The frame 12 is low to the ground, generally not more than about 3 inches. The low profile of the frame 12 makes it particularly useful for individuals with diminished agility and/or balance or with limited mobility due to injuries or disabilities to step up onto the device. The frame 12 can be constructed from any durable, but lightweight material, such as plastic or aluminum. Ideally, the device 10 is small and lightweight for portability, but sturdy enough to hold the weight of an average person and withstand movement while in use.

The sliding exercise device 10 further includes two panels which are incorporated into the frame 12. As shown in FIG. 6, a first panel 16 is positioned at or near a first end 12*a* of the frame 12. Alternatively, the first panel 16 can be positioned at or near the second end 12*b* of the frame. The first panel 16 is attached or secured to the frame using known fasteners so that it remains stationary. Alternatively, the first panel 16 can be secured in an adjustable manner and positioned into different areas of the frame, in addition to either the first end 12*a* or second end 12*b*, possibly depending on a user's specific requirements.

The second panel 18 is designed to move in a sliding motion in a longitudinal direction within the frame 12 from the first end 12*a* to the second end 12*b*, or alternatively away from where the first panel 16 is positioned on or within the frame. To enable this movement, opposing rails 20 are positioned one along an interior of each of the opposing long sides 12*c*, 12*d* forming the frame 12. As shown in FIG. 7, the underside of the second panel 18 includes a coupling element 19, including a first coupler 19*a* and a second opposing coupler 19*b* on either side of the panel, which are configured for engagement within the rail 20 of the frame and securing the second panel to the frame. The coupler 19 engagement within the rail 20 enables the smooth lateral sliding movement of the second panel 18 when the device is in use. Examples of coupling elements that may be useful for engaging the rail 20 include wheels on either side of the underside of the panel, or a corresponding rail configured for slidable engagement within the rail 20 of the frame.

The present sliding exercise device 10 is designed to exercise/rehabilitate targeted areas of the body, whether to increase strength and training, or to assist in the rehabilitation of an area of the body. One area of focus for use of the present device is to target the four sides of the hips and thighs. However, the present device 10 is also useful for working the core and upper body (FIG. 5). The present sliding exercise device 10 achieves these goals using resistance, wherein the individual steps onto the device and actively slides the second panel 18 apart or away from the first panel 16 in a repetitive horizontal sliding motion using either his/her legs (FIGS. 3 and 4) or arms (FIG. 5).

The resistance of the device 10 is achieved using a resistance component. In one embodiment, the resistance component is a plurality of large rubber bands or resistance bands 22. As shown in FIG. 4, the resistance bands 22 are secured at one end to the underside of the second panel 18 through an attachment piece 21 having a plurality of slots 23 (FIG. 7), and at a second end through a plurality of matching slots 24 in the second end 12*b* of the frame. By way of example, five slots 23 can be incorporated into the attachment piece 21 to secure five separate resistance bands; however it should be understood that the attachment piece and corresponding slots on the frame can be changed to accommodate any number of bands. Each slot 23 is custom machined to receive a single band 22. Additionally, the number of bands 22 used can be adjusted through removal or securing under the second panel through the attachment piece 21 and slots 23. Adjusting and moving the bands can be accomplished using a ring 22*a* or another form of a handle at one end of the band for the user to grasp and move or remove the bands from the attachment pieces.

Specifically, the resistance of the sliding exercise device 10 can be adjusted by increasing or decreasing the number of bands 22 secured to the second panel 18 and second end 12*b*. For example, if greater resistance is desired, more bands can be attached, and if less resistance is required, fewer bands are attached. In this manner, the number of resistance bands 22 can be varied depending on the level of resistance needed for a particular exercise or individual. Thus, therapists and trainers can scale the amount of resistance required for each individual patient or client.

As illustrated in FIGS. 3 and 4, to use the sliding exercise device 10 as a system for training or therapy, the user simply steps up and onto the two panels 16, 18. An advantage of the present exercise device 10 is that its size permits the device to be portable, such that it may be positioned or placed near a wall, or wall with a secured bar or rail in the event the user needs additional stability. Alternatively, the user may hold onto another person for support. As shown in FIG. 4, the second panel 18 may also include a vertical block 25, which the user can position his or her foot against for stability and to assist in moving the panel. The user then simply moves his or her leg on the second panel 18 in a repetitive horizontal sliding motion away from and toward the stationary first panel 16, to work the hips, glutes and associated muscles. As shown in FIG. 5, the present exercising device 10 may also be used for strengthening and therapy related to the upper body as well. Again, the same horizontal sliding motion is accomplished one at a time by the arms of the individual.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that any claim limitations presented herein are not meant to describe the invention as a whole. Moreover, the invention illustratively disclosed herein suitably may be practiced in the absence of any element which is not specifically disclosed herein.

I claim:

1. An exercise device comprising:

a frame formed from first and second opposing ends connected to first and second opposing sides creating a perimeter having an interior space;

a first panel positioned in a first position at or near the first end of the frame and outside the perimeter and interior space of the frame;

a second panel positioned within the interior space of the frame and in parallel arrangement to the first panel, wherein the first panel is capable of being interchangeably positioned in a second location within the perimeter and interior space of the frame in relation to the second panel and, wherein the first panel remains stationary in the first position or in the second position and the second panel is movable in a longitudinal direction along a length of the frame in a first direction and in a second opposing direction.

2. The exercise device of claim 1, wherein the frame includes a first rail on the first side of the frame and a second opposing rail on the second side of the frame.

3. The exercise device of claim 2, wherein the first rail and second rail are positioned within the interior space of the frame.

4. The exercise device of claim 3, wherein the second panel includes a first coupler for engagement of the second panel with the first rail and a second opposing coupler for engagement of the second panel with the second rail.

5. The exercise device of claim 4, wherein the second panel through engagement with the first rail and the opposing second rail is capable of a longitudinal sliding motion in relation to the first panel.

6. The exercise device of claim 1, wherein the first direction is away from the first panel and the second direction is toward the first panel.

7. The exercise device of claim 6, wherein the second panel is capable of repetitive sliding motion in the first direction and in the second direction in relation to the first panel.

8. The exercise device of claim 1, wherein a plurality of bands is secured beneath the second panel to the first end of the frame.

9. The exercise device of claim 8, wherein the plurality of bands is capable of adjusting a resistance of a sliding motion of the second panel.

10. The exercise device of claim 9, wherein a number of bands of the plurality of bands are capable of being changed to adjust the resistance of the sliding motion of the second panel.

11. An exercise apparatus comprising:

a frame formed from a first end and a second opposing end connected to a first side and a second opposing side creating a perimeter having an interior space;

a first panel secured in a stationary position on the frame outside the perimeter and interior space of the frame, wherein the first panel is capable of being removed and secured in the stationary position in different locations within the perimeter and interior space of the frame;

a second panel positioned within the interior space of the frame between the first side and the second opposing side, wherein the second panel is capable of movement within the interior space of the frame in a first direction away from the first panel and in a second direction toward the first panel.

12. The exercise apparatus of claim 11, wherein the exercise apparatus includes a resistance component for adjusting a resistance of the lateral movement of the second panel.

13. The exercise device of claim 11, wherein the resistance component is a series of adjustable bands secured to the second panel and the first end of the frame.

14. The exercise device of claim 11, wherein the first panel is positioned in parallel relationship to the second panel.

* * * * *